US005133275A

United States Patent [19]

Maurizio

[11] Patent Number: 5,133,275

[45] Date of Patent: Jul. 28, 1992

[54] ON BOARD DINGHY CRADLE

[76] Inventor: Anthony G. Maurizio, 1275 Wind River Dr., Palatine, Ill. 60074

[21] Appl. No.: 787,365

[22] Filed: Nov. 4, 1991

[51] Int. Cl.[5] ..... B63B 23/06

[52] U.S. Cl. ..... 114/259; 114/365; 114/366; 114/373

[58] Field of Search ..... 114/259, 365, 366, 373, 114/44, 230; 414/678; 405/3

[56] References Cited

U.S. PATENT DOCUMENTS

| | | | |
|---|---|---|---|
| 3,143,991 | 8/1964 | Anderson | 114/365 |
| 3,401,806 | 9/1968 | Schmit | 114/366 X |
| 3,647,089 | 3/1972 | Christensen | 114/373 X |
| 3,834,338 | 9/1974 | Ronouf | 114/373 X |
| 4,864,951 | 9/1989 | Koepp, Jr. | 114/366 |

FOREIGN PATENT DOCUMENTS

| | | | |
|---|---|---|---|
| 792095 | 8/1968 | Canada | 414/678 |

*Primary Examiner*—Sherman Basinger
*Attorney, Agent, or Firm*—Charles F. Meroni, Jr.

[57] ABSTRACT

The on board dinghy cradle comprises a framework of hollow tubings which are secured together by fittings and connectors. The framework produced includes bottom cross members which extend across the width of the dinghy at a predetermined distance below the bottom surface thereof. Side tubings are also provided for positioning one side of the dinghy close to a supporting surface for the cradle, such as a swim platform, and to keep the dinghy from moving away as it is being boarded or left. The cradle is pivotably mounted to the supporting structure so it can be pivoted to a vertical storage position, having the dinghy, with or without a small motor attached thereto, up and out of the water.

15 Claims, 3 Drawing Sheets

ON BOARD DINGHY CRADLE

BACKGROUND OF THE INVENTION

The present invention relates to a cradle which is adapted to engage a floating inflatable dinghy and then pivot over a section of a main mother vessel for on board storage of the dinghy, with or without a small motor mounted thereon.

PRIOR ART

Heretofore, various embodiments of davits have been proposed for use in engagement of a dinghy to a mother vessel for secure transporting thereof by the mother vessel.

Typically such davits comprise a pair of crane-like arms from which ropes extend downwardly into engagement with opposite longitudinal ends of the dinghy, by means of which the dinghy can be lifted out of the water and transported by the mother vessel. Because the dinghy is maintained upright, it must be covered to keep it from filling with water, such as during a rain storm.

Further, a snap clip arrangement has been proposed which provides two snap clips which are secured to one side of the dinghy, with the dinghy being pivoted out of the water about a hinge provided in each clip and then fixed in the upright position to the mother vessel. When the dinghy is being boarded or left, significant amounts of stress are placed on the clip engaging areas of the dinghy, often causing release of the dinghy mounted engagement structure. Also, there is no way provided to secure the seats of the dinghy in place during storage.

As will be described in greater detail hereinafter, the on board dinghy cradle of the present invention differs from the proposed structures by providing a cradle frame which engages along longitudinal sides of the dinghy as well as extending below the underside thereof, a distant edge of the cradle being upwardly pivotable, singlehandedly, to store the dinghy against a wall of the mother vessel. Because such engagement between the cradle and the dinghy is extremely stable, the dinghy may have its motor remain attached thereto during storage thereof.

SUMMARY OF THE INVENTION

According to the invention there is provided a cradle for on board engagement of an inflatable dinghy and a motor thereof comprising: a plurality of clevis type brackets engaged to a stern structure of a mother vessel; an equal plurality of arms pivotably engaged to the clevis brackets; a fitting on each arm adapted to engage a side tube member extending between the arms; a side tube member engageable to and between the arm fittings; an equal plurality of cross members, each cross member having ends thereof which are turned perpendicular thereto; the fitting on the arms being further adapted to engage a first perpendicular end of one cross member in downwardly depending fashion; each cross member being parallel to the other and extending perpendicularly outwardly away from the stern structure; a connector engaged to a second perpendicular end of each cross member and being adapted to engage a side tube member as well; and a side tube member engaged between the connectors.

There is also provided a kit for creating an on board dinghy cradle comprising: a pair of clevis type brackets engaged to a stern structure of a mother vessel; several pairs of arms adapted to be pivotably engaged to the clevis brackets, each pair varying in length from the other pairs; a fitting on each arm adapted to engage a side tube member extending between the arms; a side tube member engageable to and between the arm fittings; a pair of cross members, each cross member having ends thereof which are perpendicular thereto; the fitting on the arms being further adapted to engage a first perpendicular end of one cross member in downwardly depending fashion; each cross member being parallel to the other and extending perpendicularly outwardly away from the stern structure; a connector engaged to a second perpendicular end of the cross member and being adapted to engage a side tube member as well; and a side tube member engaged between the connectors.

DESCRIPTION OF THE PREFERRED EMBODIMENT

Figure 1:
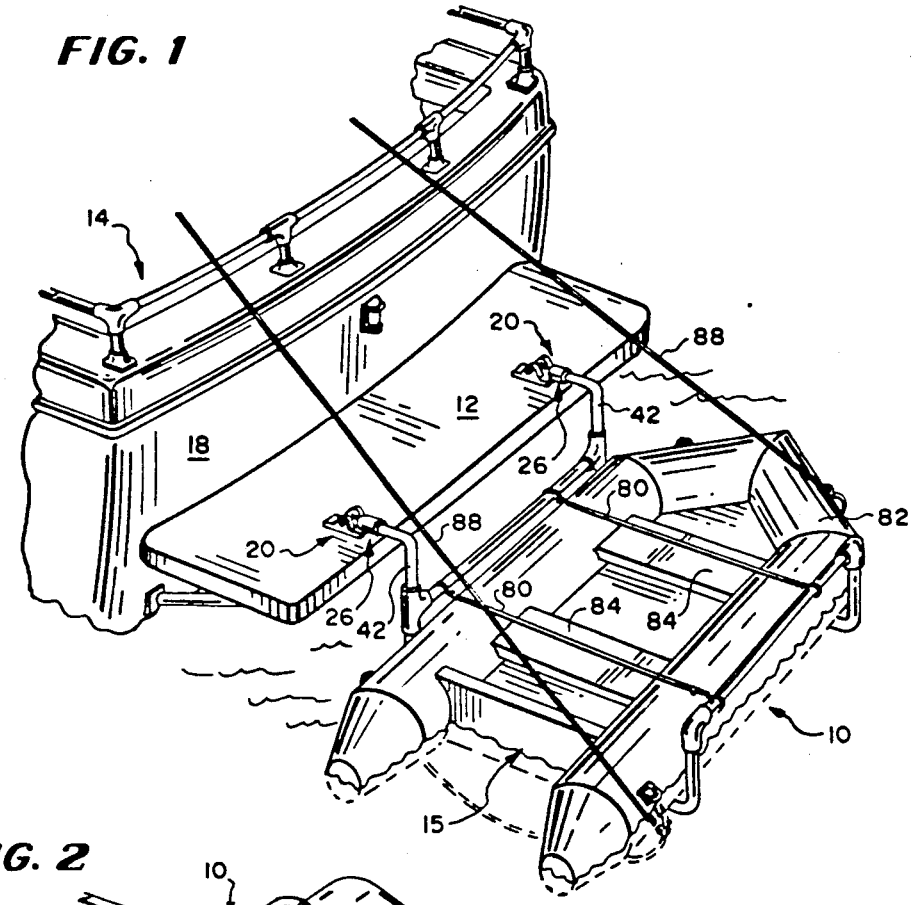
FIG. 1 is a perspective view showing the on board dinghy cradle of the present invention in flotational position dependingly engaged to a swim platform of a vessel and shows a inflatable dinghy secured thereto.

Referring now to the drawings in greater detail, there is illustrated therein the on board dinghy cradle of the present invention generally identified by reference numeral 10.

The cradle 10 is shown as being dependingly engaged to a swim platform 12 of a mother vessel 14, such as a power or sail boat 14, and cradling an inflatable dinghy 15 therein.

Although not illustrated, it will be understood that the cradle 10 could be engaged directly to a stern wall 18 of the vessel 14, in known manner.

Figure 2:
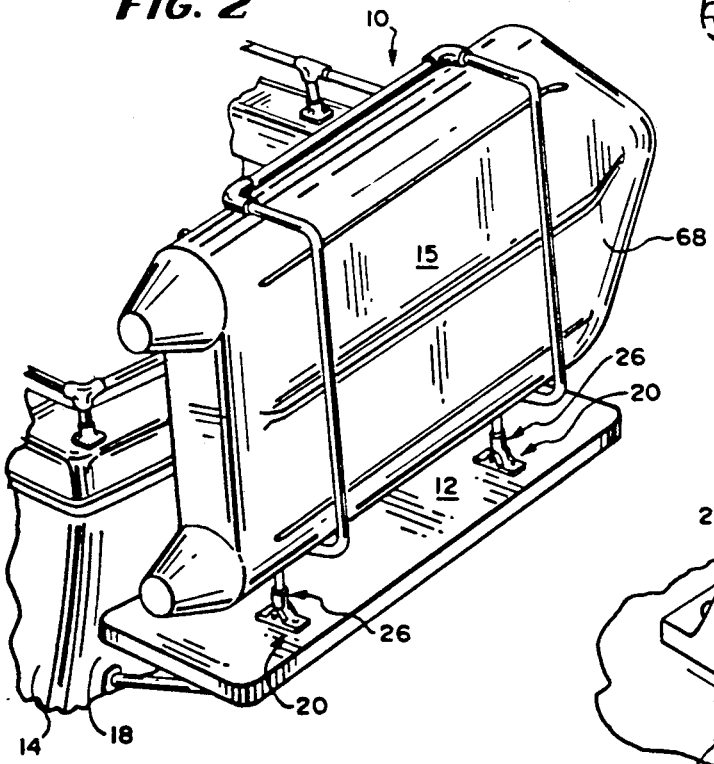
FIG. 2 is similar to FIG. 1 but shows the dinghy and cradle in a vertical, storage position thereof.
Figure 4:
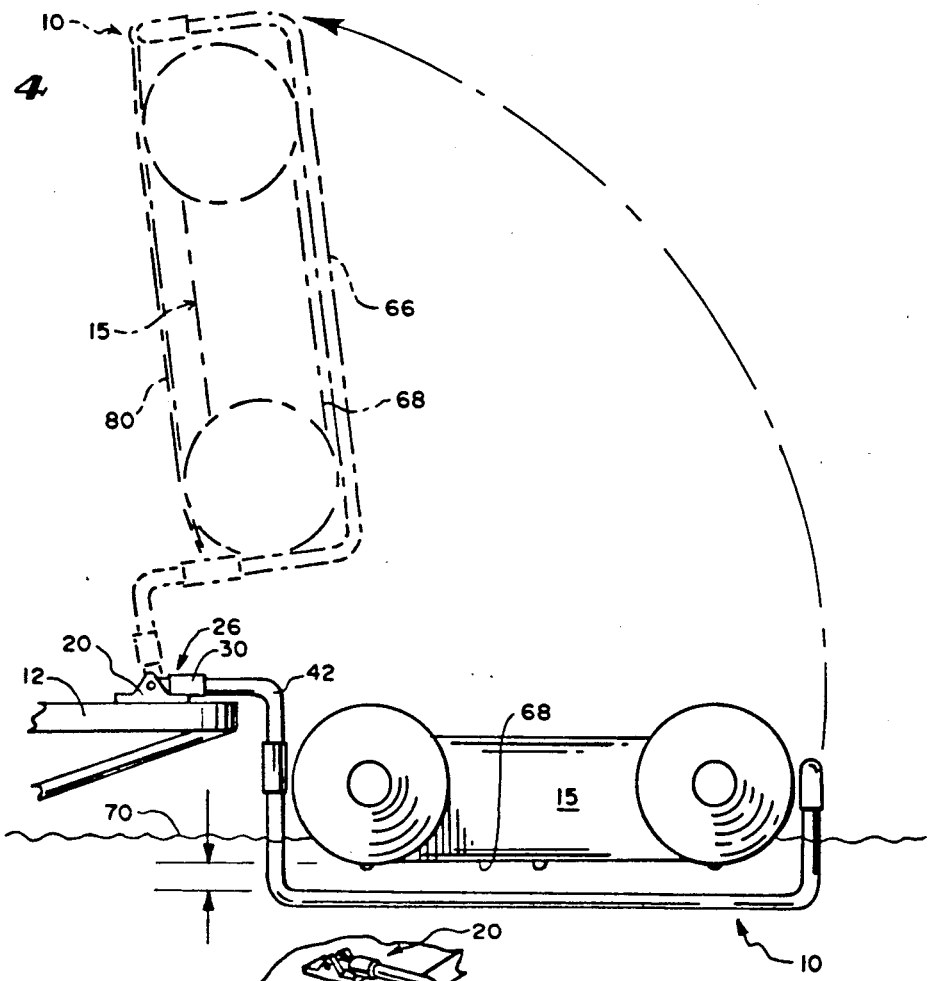
FIG. 4 is an end view of the cradle and associated dinghy in a flotational position thereof, showing the storage position of the structures in phantom.
Figure 5:
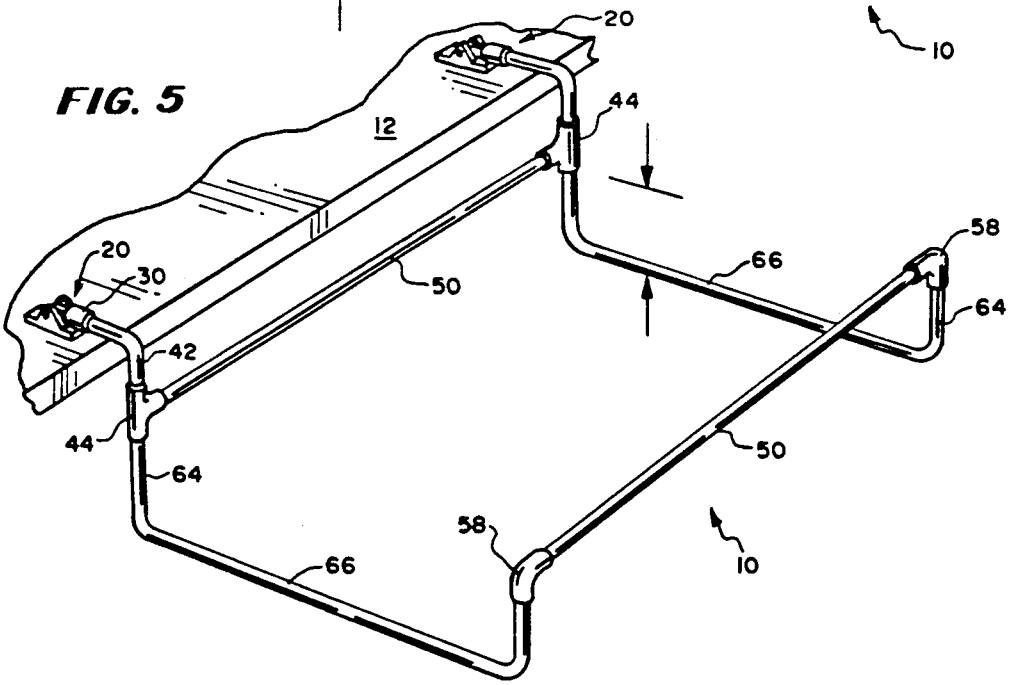
FIG. 5 is a perspective view of the cradle and shows same engaged to a swim platform of a mother vessel.

Obviously, the cradle 10 must be pivotably mounted to the chosen supporting surface 12 so that it may be pivoted from a flotation position to a vertical storage position, as shown in FIGS. 1, 2 and 4.

To accomplish this, mounting structure for the cradle 10 comprises two clevis brackets 20 which are secured to the supporting surface 12 at predetermined locations therealong and equidistant from the center of the platform 12.

Figure 3:
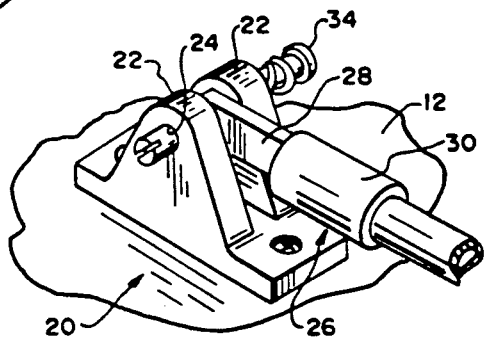
FIG. 3 is an enlarged perspective view of one bracket structure used in engaging the cradle to the swim platform.

As best shown in FIG. 3 each bracket 20 includes two wings 22 having bores 24 therein aligned with one another. Between these wings 22 is engaged an attachment arm 26 which includes a lever arm 28 and a clevis cap 30. The lever arm 28 has a bore (not shown) therein which aligns with the bores 24 in the wings 22 of the clevis bracket 20. Through these aligned bores is inserted a spring loaded clevis hinge pin 34 about which the attachment arm 26 pivots.

To the clevis caps 30 is attached the remainder of the cradle 10.

As shown, at least one pair of L shaped tubing arms 42 is provided, each of which is dependingly engaged at one end to one clevis cap 30 and at the other end to a top opening 43, of a tee fitting 44. A side opening 45 in each tee fitting 44 faces the side opening 45 in the other tee fitting 44 and between and within these opposed side openings 45 is received a side tube 50 of predetermined length.

This side tube 50 is equal in length to a second side tube 50 which engages one opening 54 of an L shaped connector 58, the other opening 60 of which is downwardly directed.

Engaged to and between the downwardly directed opening 60 of one connector 58 and a downwardly directed opening 62 of a corresponding tee fitting 44 is an upturned flange or arm 64 of a tubular cross member 66.

The distance between the upturned arms 64 of the cross member 66 is such that it will accommodate the width of a dinghy 15 therebetween.

Further, because of the differing lengths of dinghies 15 available, the side tubes 50 may be of a correspondingly longer or shorter span.

It will be obvious that the distance between the clevis brackets 20 is determined by the span of the side tubes 50.

In use of the cradle 10, a dinghy is propelled into the space defined between the side tubes 50.

Clearance for a bottom 68 of the floating dinghy 15 is provided for by means of the provision of a plurality of sets of L shaped arms 42.

In this respect, inflatable dinghies 15 come in several depths. Also, not all swim platforms 12 are mounted the same distance from the water line 70. To create a stress free engagement between the cradle 10 and its supporting surface 12, the cross members 16 are positioned several inches below the bottom surface 68 of the floating dinghy 15 as shown in FIG. 4. This allows the water, rather than the cradle 10, to absorb the difference in weight as the dinghy 15 is boarded or left.

This positioning of the cross members 66 is accommodated by providing a plurality of pairs of L shaped arms 42, each pair being of a different length. By choosing an appropriate length for the arms 42, clearance below the bottom surface 68 of the dinghy 15 can be assured.

When it is desired to place the cradle 10 and its engaged dinghy 15 in the storage position thereof, the dinghy is pressed against the bottom surface of the cradle 10 by running cords 80 across a top surface 82 thereof, between side tubes 50. These cords 80 are preferably engaged in an area where they secure removable seats 84 of the dinghy 15 therewithin.

A line 88 is then engaged to one of a plurality of fixtures (not shown) provided on the sides of the dinghy 15, swung out around the far edge of the cradle 10 and pulled in, to pivot the cradle 10 and dinghy 15 engaged thereto about the clevis bracket 20 into a vertical position. The lines 88 can then be secured in known manner to maintain the cradle 10 vertical.

It will be understood that, as the cradle 10 and dinghy 15 are brought out of the water, the bottom surface 68 of the dinghy 15 eventually comes to rest against the cross members 66, being secured thereagainst by the cords 80.

To lower the cradle 10 and dinghy 15 into the flotation position, the lines 88 are freed and fed out, allowing the cradle 10 to pivot back into the water.

The lines 88 are disengaged, the securing cords 80 are removed, and the dinghy 15 now floats freely within the confines of the cradle 10, ready to be boarded.

Inasmuch as the arms 42, tubes 50, fittings 44, cross members 66 and connectors 58 are secured together in an air tight manner the cradle 10 is virtually unsinkable, should it accidentally be disengaged from the brackets 20.

As described above, the on board dinghy cradle 10 of the present invention has a number of advantages, some of which have been described above, and others of which are inherent in the invention.

Figure 6:
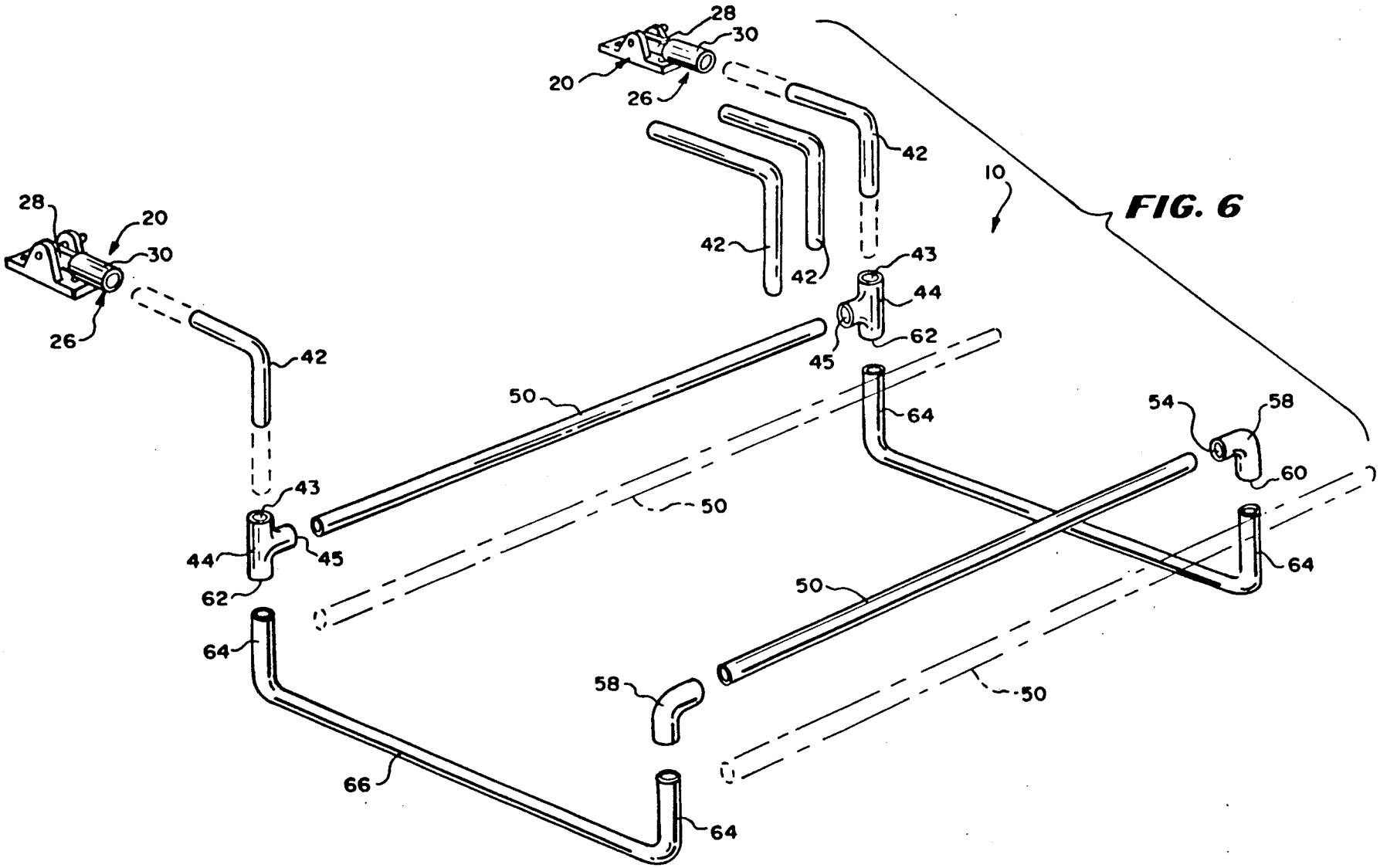
FIG. 6 is an exploded perspective view showing all the elements forming the on board dinghy cradle, as well as auxiliary arms therefor, which determine how deeply the cradle sits in the water.

In FIG. 6, I have shown a complete kit which constitutes the equipment that is shipped from the manufacturer and/or the distributor to the ultimate user. As will be seen from FIG. 6, the kit includes a pair of clevis brackets 20. While the kit is particularly shown as including clevis-brackets 20, it will be appreciated that other types of brackets could be substituted for these brackes without departing from the scope of my invention. It will further be seen in FIG. 6 that I have diagrammatically illustrated the kit as including three different sized pairs of arms 42. When the ultimate user receives the kit, he will select which of the differently size brackets best suits his requirement and he will then discard the extra sets of arms that are not used. It will further be seen that two sets of tubes 50 are shown in FIG. 6 with one set of tubes being shown in full line and the other being shown in dotted line. By using different lengths of tubes 50, the length of the cradle can be varied as may be required according to the size of the dinghy to be mounted in the cradle. Other than as set forth in this paragraph, it is believed that the kit is fully described elsewhere, and that no further description need be made.

Also, modifications can be proposed to the cradle 10 without departing from the teachings herein.

Accordingly, the scope of the invention is only to be limited as necessitated by the accompanying claims.

I claim:

1. A cradle for on board engagement of an inflatable dinghy and motor thereof comprising:

a plurality of clevis type brackets engaged to a stern structure of a mother vessel;

an equal plurality of arms pivotably engaged to said clevis brackets;

a fitting on each arm adapted to engage a side tube member extending between said arms;

a side tube member engageable to and between said arm fittings;

an equal plurality of cross members, each cross member having ends thereof which are perpendicular thereto;

said fitting on said arms being further adapted to engage a first perpendicular end of one cross member in downwardly depending fashion;

each cross member being parallel to the other and extending perpendicularly outwardly away from said stern structure;

a connector engaged to a second perpendicular end of said cross member and being adapted to engage a side tube member as well;

and a side tube member engaged between said connectors.

2. The cradle of claim 1 wherein said plurality is two.

3. The cradle of claim 2 wherein said arms are L shaped.

4. The cradle of claim 3 wherein pairs of said arms are of varied lengths.

5. The cradle of claim 4 wherein said tubes, fittings, connectors, arms and cross members are connected in air tight fashion.

6. The cradle of claim 5 wherein said side tube members are equal in length.

7. The cradle of claim 6 wherein said cross members are equal in length.

8. The cradle of claim 7 wherein said L shaped arms of each pair are identical.

9. The cradle of claim 8 wherein the length of said cross members is determined by the width of the dinghy.

10. The cradle of claim 9 wherein the length of said side tube members is determined by the length of the dinghy.

11. The cradle of claim 10 wherein the length of said L shaped arms is determined by the depth of the dinghy and the distance from the supporting structure to the water line.

12. The cradle of claim 11 wherein said cross members extend beneath the dinghy a predetermined distance.

13. The cradle of claim 12 wherein said predetermined distance is determined by the length of said L shaped arms.

14. A kit for creating an on board dinghy cradle comprising:

a pair of clevis type brackets engaged to a stern structure of a mother vessel;

several pairs of arms adapted to be pivotably engaged to said clevis brackets, each pair varying in length from the other pairs;

a fitting on each arm adapted to engage a side tube member extending between said arms;

a side tube member engageable to and between said arm fittings;

a pair of cross members, each cross member having ends thereof which are perpendicular thereto;

said fitting on said arms being further adapted to engage a first perpendicular end of one cross member in downwardly depending fashion;

each cross member being parallel to the other and extending perpendicularly outwardly away from said stern structure;

a connector engaged to a second perpendicular end of said cross member and being adapted to engage a side tube member as well;

and a side tube member engaged between said connectors.

15. A kit for creating an on board dinghy cradle comprising:

a pair of cradle mounting brackets for attachment to a stern structure of a mother vessel;

several pairs of arms adapted to be pivotably engaged to said cradle mounting brackets, each pair varying in length from the other pairs with only one length of arms being usable in an installation depending on where a cradle is vertically positioned with respect to said cradle mounting brackets;

a fitting on each arm adapted to engage a side tube member extending between said arms;

a side tube member engageable to and between said arm fittings;

a pair of cross members, each cross member having ends thereof which are perpendicular thereto;

said fitting on said arms being further adapted to engage a first perpendicular end of one cross member in downwardly depending fashion;

each cross member being parallel to the other and extending perpendicularly outwardly away from said stern structure;

a connector engaged to a second perpendicular end of said cross member and being adapted to engage a side tube member as well; and a side tube member engaged between said connectors.

* * * * *